US009913520B1

(12) United States Patent
Torres

(10) Patent No.: US 9,913,520 B1
(45) Date of Patent: Mar. 13, 2018

(54) LIGHT PRODUCING HAIR COMB

(71) Applicant: Chuka A. Torres, Sacramento, CA (US)

(72) Inventor: Chuka A. Torres, Sacramento, CA (US)

( * ) Notice: Subject to any disclaimer, the term of this patent is extended or adjusted under 35 U.S.C. 154(b) by 38 days.

(21) Appl. No.: 15/065,694

(22) Filed: Mar. 9, 2016

Related U.S. Application Data

(60) Provisional application No. 62/131,389, filed on Mar. 11, 2015.

(51) Int. Cl.

| | |
|---|---|
| ***A45D 24/10*** | (2006.01) |
| ***F21S 9/02*** | (2006.01) |
| ***F21V 21/00*** | (2006.01) |
| ***F21V 23/04*** | (2006.01) |
| ***F21V 33/00*** | (2006.01) |
| *F21Y 101/02* | (2006.01) |

(52) U.S. Cl.
CPC ..... *A45D 24/10* (2013.01); *F21S 9/02* (2013.01); *F21V 21/00* (2013.01); *F21V 23/04* (2013.01); *F21V 33/0004* (2013.01); *F21Y 2101/02* (2013.01)

(58) Field of Classification Search
CPC ..... A45D 1/18; A45D 2/001; A45D 20/48; A45D 20/50; A45D 20/52; A45D 24/00; A45D 24/007; A45D 24/02; A45D 24/04; A45D 24/06; A45D 24/10; A45D 24/16; A46B 15/0036
See application file for complete search history.

(56) References Cited

U.S. PATENT DOCUMENTS

| | | | | |
|---|---|---|---|---|
| 5,618,289 | A * | 4/1997 | Aragona | A01K 13/002 15/105 |
| 6,053,180 | A * | 4/2000 | Kwan | A01K 13/00 132/118 |
| 7,339,754 | B2 * | 3/2008 | Neal | A45D 26/0066 294/99.2 |
| 2002/0077679 | A1 * | 6/2002 | Lo | A61N 5/0617 607/90 |
| 2004/0193236 | A1 * | 9/2004 | Altshuler | A46B 15/0002 607/88 |
| 2005/0251242 | A1 * | 11/2005 | Bousfield | A61N 1/322 607/150 |
| 2006/0027554 | A1 * | 2/2006 | Hashimoto | A45D 26/0009 219/225 |
| 2006/0178713 | A1 * | 8/2006 | Maricle | A61N 5/0617 607/89 |
| 2007/0149900 | A1 * | 6/2007 | Lin | A61H 7/006 601/15 |

* cited by examiner

*Primary Examiner* — Hargobind S Sawhney
(74) *Attorney, Agent, or Firm* — Heisler & Associates

(57) ABSTRACT

The comb includes a shaft with teeth extending therefrom, preferably including fine teeth and coarse teeth. A light is coupled to the comb. The light is preferably in the form of an LED and carried on a light module which is removably attachable to the shaft of the comb. This light module includes a circuit therein, a source of electric power typically in the form of a battery and a switch. The switch can be manipulated to cause power from the battery to pass through the circuit to the LED (or other light) to cause light to shine from the comb. The light module is removably attachable to facilitate cleaning of other portions of the comb, such as by submersion in a cleaning liquid.

4 Claims, 4 Drawing Sheets

LIGHT PRODUCING HAIR COMB

CROSS-REFERENCE TO RELATED APPLICATIONS

This application claims benefit under Title 35, United States Code § 119(e) of U.S. Provisional Application No. 62/131,389 filed on Mar. 11, 2015.

FIELD OF THE INVENTION

The following invention relates to hair combs, such as those including a shaft with teeth extending therefrom. More particularly, this invention relates to hair combs which include lights thereon, and particularly lighting which can be removed from other portions of the comb, such as to facilitate sanitizing of portions of the comb which do not include electronics therein.

BACKGROUND OF THE INVENTION

Combs come in a variety of different shapes and configurations for the styling of hair. Combs generally have in common a spine with a plurality of parallel teeth extending generally perpendicular from a length of the spine. With some combs teeth extend from opposite sides of the spine. With some combs course teeth and fine teeth extend from different regions of the spine. With some combs a handle extends from the spine, either along a long axis of the spine or perpendicular to the spine or in some other orientation relative to the spine.

Typically, the comb has its teeth slid between locks of hair to be styled and then is moved generally perpendicular to a direction in which the teeth extend from the spine. This causes the teeth to pass through the hair and to cause the hair to line up generally with the direction that the comb is moving.

Combs are used in styling hair, often along with other tools including scissors, clippers (typically electric clippers), razors and other styling tools such as spray bottles, blow dryers, liquid hair styling additives and other styling accessories.

When styling hair it is important that sufficient light be provided so that one can see how the styling activities are acting upon the hair and so that a desired outcome is achieved. The light can be provided by cutting the hair during daylight outdoors, through large daylight windows in a barbershop or styling salon or similar location, or through artificial lights, sufficiently bright so that the hair stylist can clearly see the hair that is being styled.

On occasion circumstances dictate that hair be styled in a location which has inadequate light. While a stylist could provide a separate handheld lighting tool, such as a flashlight, such an additional light would require typically that it be held by a hand of the stylist or require an additional person to hold the light for the stylist to be able to see. Because the stylist typically needs both hands available for effectively implementing the styling procedures, such as utilizing a comb in one hand and scissors or clippers in the other hand, the stylist does not have a convenient opportunity to hold the light while styling the hair. Accordingly, a need exists for an apparatus and method to provide lighting to augment the light available to a stylist, which is conveniently carried by the stylist but does not require one of the hands of the stylist to be dedicated to the holding of the light, but rather leaves both hands of the stylist free to perform hairstyling procedures.

SUMMARY OF THE INVENTION

With this invention a comb is provided which has a light included thereon. With such a tool, a stylist can utilize the comb simultaneously both for styling the hair and for directing light on an area to be styled. This leaves the second hand of the stylist free for other styling procedures, such as managing scissors or clippers.

In one exemplary embodiment the comb is of a standard variety with a spine having a series of fine teeth extending from one portion thereof and a series of course teeth extending from a portion thereof. A light is provided on the spine and shining away from one of the surfaces of the spine. As one exemplary embodiment, the light is in the form of a light emitting diode (LED) but could be any form of light, typically powered by an electric power source. The comb in this embodiment also carries batteries and circuitry to power the light. A button is also preferably provided to open and close the circuitry between the battery and the light. While in a simplest embodiment a single LED is provided, alternative embodiments could include multiple LEDs or other lights, such as along one surface of the spine, or emanating from both surfaces on opposite sides of the spine. In still further embodiments, a button for switching the circuitry to provide power to the lights could have multiple settings such as a setting for a single light and a setting for multiple lights, or a setting for lights from one side of the spine and a setting for light from both sides of the spine or from just the opposite surface of the spine.

In the embodiment disclosed, the LED (or other light) along with its supporting circuitry, switch and battery are all contained within a light module which is removably attachable to the spine of the comb. In this exemplary embodiment, a notch in the spine is sized complementally with a shape of the light module. A complemental tongue and groove fastener is provided with one portion thereof on a boundary of the notch and the other portion thereof located on a perimeter of the light module, so that the tongue or groove on the boundary of the notch can connect with the groove or tongue on the lighting module to removably hold the lighting module to the comb.

Such removability of the light module allows the comb without the light module attached thereto to be easily sanitized in a most traditional fashion, such as dipping of the comb into a liquid disinfecting cleaner or other cleaning preparation. Similarly, such removability facilitates cleaning of the comb under a running faucet or in a basin of water and can allow for occasional more thorough cleaning of the comb if desired without involving the light module. Also, such removability facilitates swapping of different lighting modules into and out of the comb if desired. As a further alternative in some embodiments, the lighting module could be fitted with a connector to allow it to be coupled to a separate electric power source for recharging of rechargeable batteries.

OBJECTS OF THE INVENTION

Accordingly, a primary object of the present invention is to provide light from a comb to enhance the quality of light adjacent an area where the comb is used.

Another object of the present invention is to provide a comb which includes light thereon.

Another object of the present invention is to provide a comb with a light module which can be removed so that other portions of the comb can be immersed in sterilizing liquid according to a method of this invention.

Another object of the present invention is to provide a comb with a light module which can be removed and reattached in two opposite orientations to facilitate both left and right handed use.

Another object of the present invention is to provide a lighted comb with a light on a module removable from other portions of the comb so that the light module can be replaced if needed.

Another object of the present invention is to provide a comb which is effective in hair styling and also includes light thereon.

Another object of the present invention is to provide a lighted comb with a switch coupled to an electric circuit powering the light so that the light can be turned on and off, such as to save battery life when the light is not needed.

Other further objects of the present invention will become apparent from a careful reading of the included drawing figures, the claims and detailed description of the invention.

DESCRIPTION OF THE PREFERRED EMBODIMENT

Figure 1:
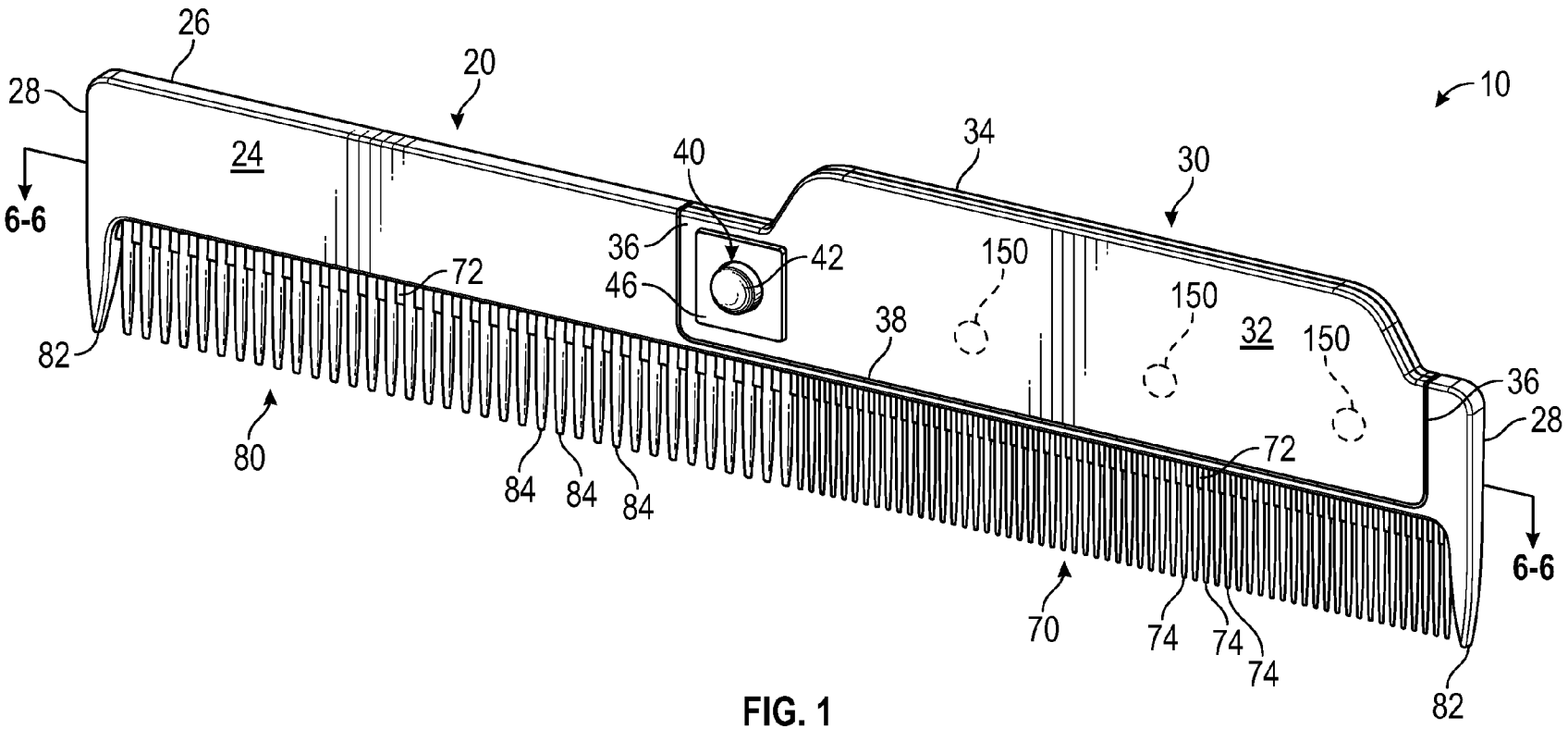
FIG. 1 is a perspective view of the comb of this invention from a front side and showing a button on a light module attached to a shaft of the comb.

Referring to the drawings, wherein like reference numerals represent like parts throughout the various drawing figures, reference numeral 10 is directed to a comb which includes a light thereon. The light can be provided from a light emitting diode (LED) 50 or other light. This LED 50 (or other light) is preferably removably attachable, such as by being provided on a light module 30 which is removably attachable to a shaft 20 of the comb 10. The LED 50 (or other light) allows the comb 10 to be used in areas where light is insufficient, for maximum beneficial use of the comb 10, such as when styling hair in a poorly lit location.

Figure 2:
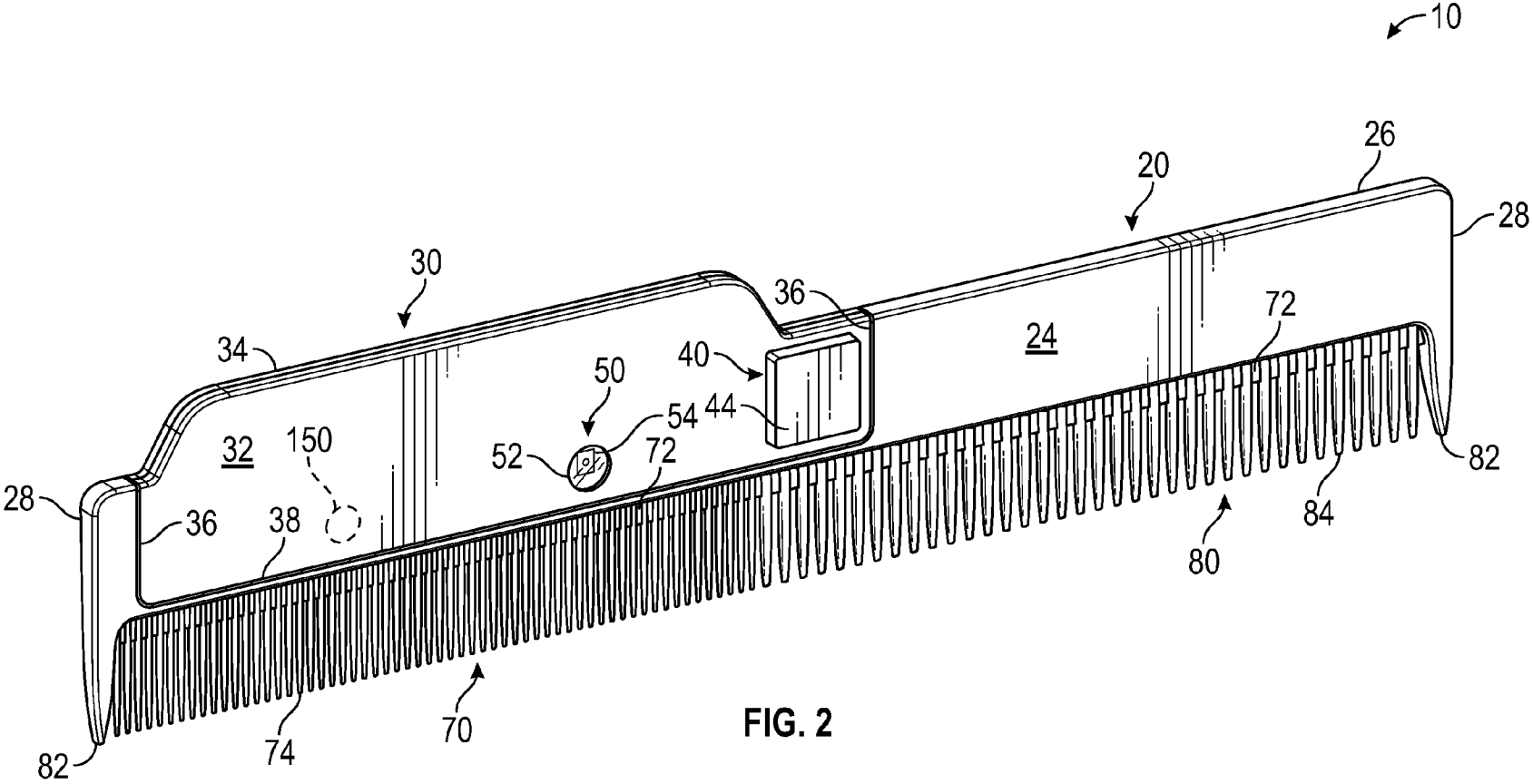
FIG. 2 is a perspective view similar to that which is shown in FIG. 1, but from a reverse side, and showing a light thereon.
Figure 3:
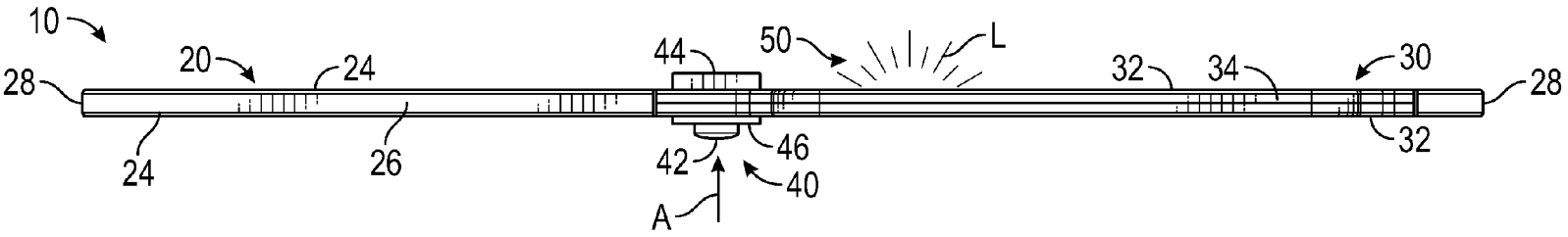
FIG. 3 is a top plan view of that which is shown in FIG. 1 and with rays of light emanating from the light thereof.
Figure 4:
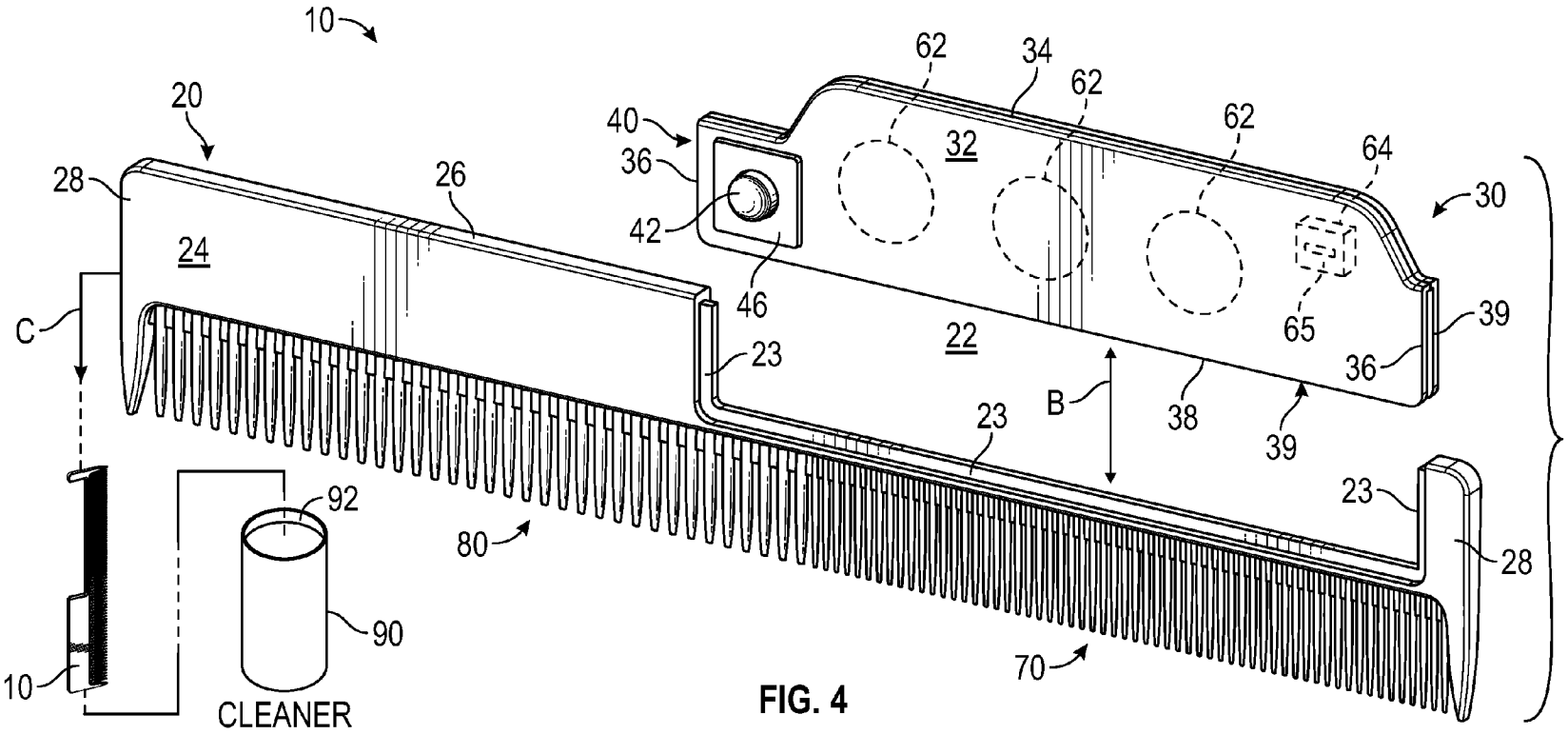
FIG. 4 is a perspective exploded view of that which is shown in FIG. 1, with the light module including the light thereon exploded away from a shaft and teeth of the comb, and also illustrating how the shaft and teeth of the comb can together be placed into a cleaning liquid without the light module.
Figure 6:
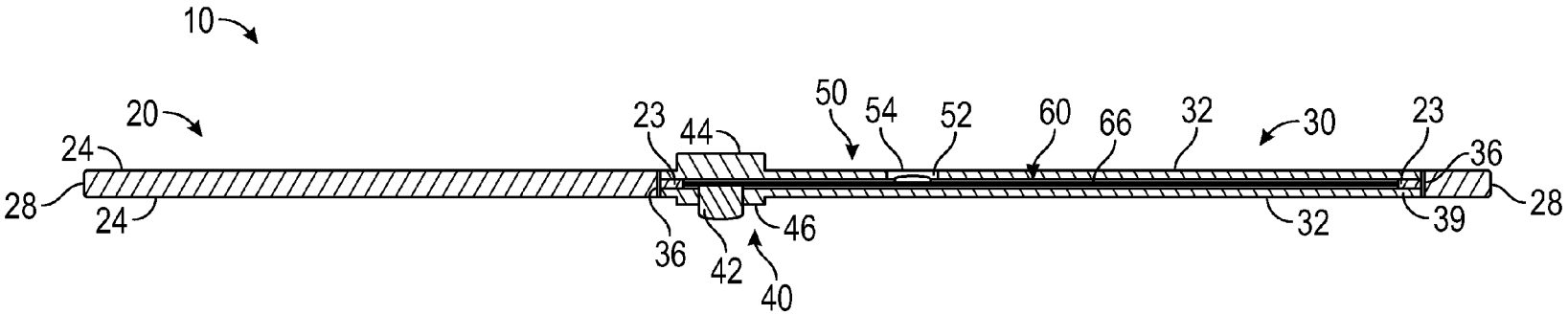
FIG. 6 is a full sectional view of that which is shown in FIG. 1 and illustrating interior details of the light module attached to the shaft and teeth of the comb.

In essence, and with particular reference to FIGS. 1 and 2, basic details of the comb 10 are described, according to a preferred embodiment. The comb 10 is formed of an elongate shaft 20 with a plurality of teeth extending therefrom including fine teeth 70 and coarse teeth 80 in this embodiment. A light module 30 is removably attachable to the shaft 20 of the comb 10. This light module 30 includes a switch 40 for activating and deactivating an LED 50 (or other light). A circuit 60 (FIG. 6) connects the switch 40 to the LED 50 and provides power to the LED 50 (such as from batteries 62 (FIG. 4)) when activated by the switch 40.

More specifically, and with continuing reference to FIGS. 1 and 2, particular details of the shaft 20 and teeth 70, 80 are described according to this preferred embodiment. The shaft 20 and teeth 70, 80 are preferably all formed together as a monolithic structure. The shaft 20 is elongate in form extending between end edges 28 spaced apart by a length defining a greatest dimension of the shaft 20. This shaft 20 preferably has a thin dimension of least size between parallel opposite surfaces 24. A back edge 26 spans the surfaces 24 and between the end edges 28, with the back edge 26 on a side of the shaft 20 opposite the teeth 70, 80.

The shaft 20 and teeth 70, 80 are typically formed of an injection moldable plastic, but could be formed of other materials including wood, bone, ivory, stainless steel or other materials known to be used in the comb manufacture arts, or developed in the future. The shaft 20 preferably has a height between the back edge 26 and the teeth 70, 80 which is similar to a length of the teeth 70, 80. In one embodiment this height of the shaft 20 is approximately ¾ of an inch with the teeth 70, 80 also having a length of approximately ¾ of an inch. In this exemplary embodiment, a thickness of the shaft 20 between the surfaces 24 is approximately ⅛ of an inch. A length between the end edges 28 is in this exemplary embodiment about eight inches long. Other dimensions for the length, height or thickness of the shaft 20 and other portions of the comb 10 could alternatively be provided.

The shaft 20 preferably includes a notch 22 which cuts into the shaft 20 on approximately half (but in this embodiment slightly more than half) of a length of the shaft 20. This notch 22 is sized to receive a light module 30 therein which includes the LED 50 (or other light) thereon. To facilitate removable attachment of the light module 30 to the shaft 20, this notch 22 is preferably bounded by a tongue 23 which extends away from edges of the notch 22 within a plane coplanar with the surfaces 24 and aligned with a central plane midway between the surfaces 24. This tongue 23 fits complementally with a perimeter groove 29 in the light module 30, described in detail below.

As an alternative, a light could be provided on the shaft 20 in a manner permanently affixed to the shaft 20. Such a light could be built into an interior of the shaft 20 or merely mounted upon a surface of the shaft 20. Such a light could be provided at various different locations between the end edges 28 of the shaft 20. While in this embodiment a single light is contemplated, it is also conceivable that multiple lights 150 (FIGS. 1 and 2) could be provided along a length of the shaft 20 (and optionally on both surfaces of the shaft 20).

The fine teeth 70 and coarse teeth 80 extend from a portion of the shaft 20 opposite the back edge 26. These teeth 70, 80 are preferably supported where they attach to the shaft 20 through inclusion of a bridge 72 to which each of the teeth 70, 80 are coupled. This bridge 72 causes the teeth 70, 80 to be supported by adjacent teeth 70, 80 somewhat to make the teeth 70, 80 stronger. The fine teeth 70 extend to tips 74 which are preferably equally spaced from each other by gaps between the adjacent fine teeth 70. Similarly, the course teeth 80, which are concentrated at one end of the comb 10 spaced from the fine teeth 70, also extend to tips 84. These tips 84 are also preferably uniformly spaced from adjacent coarse teeth 80 by gaps therebetween. End teeth 82 are provided extending from the end edges 28 of the shaft 20 and parallel with the teeth 70, 80. These end teeth 82 are typically somewhat thicker than the coarse teeth 80.

While the teeth 70, 80 are preferably formed monolithically along with the shaft 20, such as through injection molding or forming from a common original mass of material, it is conceivable that the teeth 70, 80 could be removably attachable to the shaft 20, such as by providing the teeth 70, 80 on a separate structure which is removably attachable to the shaft 20 through utilization of fasteners or by forming portions of the teeth 70, 80 to have a geometric form which is complemental with a portion of the shaft 20 to allow the teeth 70, 80 to snap onto such a complementally formed geometric portion of the shaft 20, or slide into such a complementally geometrically formed portion of the shaft 20.

With particular reference to FIGS. 1-4, details of the light module 30 are described, according to this preferred embodiment. While the light module 30 could be permanently affixed to the shaft 20 of the comb 10, the light module 30 preferably is formed separately from other portions of the comb 10 and removably attachable to the shaft 20 and other portions of the comb 10. The light module 30 carries the switch 40 for selectively providing power to the LED 50 from the circuit 60. Providing such functional electronics along with the light on the separate and removably attachable light module 30 allows for other portions of the comb 10 to be immersed in liquids, such as sterilizing liquids 92 located within a cleaner canister 90 (FIG. 4, such as by movement along arrow C), without concern for waterproofing the light module 30.

The light module 30 includes parallel spaced apart module surfaces 32 which preferably define a thickness of the light module 30 having a thickness similar to the shaft 20. A rear hump 34 is preferably provided which causes the light module 30 to be somewhat greater in height than the shaft 20. Such an enhanced height allows the light module 30 to hold larger batteries and for the light module 30 to provide an area where a user can have more surface area for gripping than provided by the shaft 20.

The light module 30 extends between tip edges 36 defining a greatest dimension of the light module 30 and generally aligned with a length of the shaft 20 between the end edges 28. A front edge 38 is provided between the two tip edges 36 being preferably larger than the end edges 28 and oriented perpendicular to the end edges 28 on the light module 30. A perimeter groove 38 is preferably formed in each of the tip edges 36 as well as in the front groove 38. This perimeter groove 39 is formed complementally with the tongue 23 in the edges of the notch 22 in the shaft 20. The perimeter groove 39 can snap onto the tongue 23 to cause the light module 30 to be removably attachable to the shaft 20.

Figure 5:
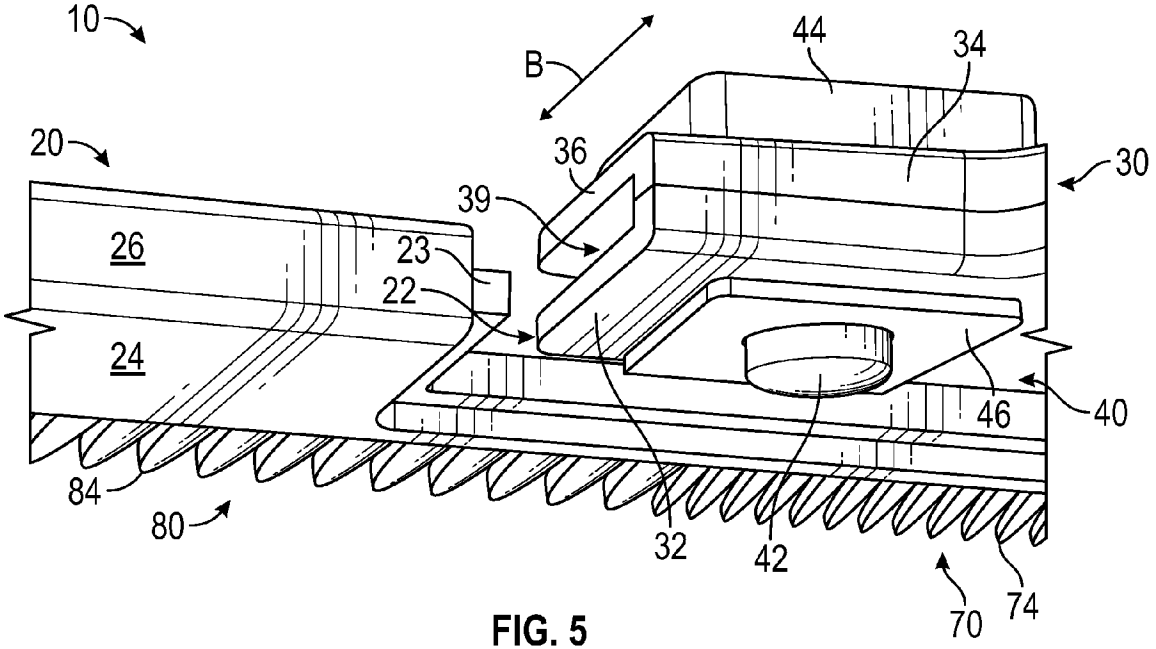
FIG. 5 is a perspective detail of a portion of that which is shown in FIG. 4 and illustrating how the light module can have a groove thereof fit onto a tongue within a notch in the shaft of the comb for removable attaching of the light module to the shaft of the comb.

In one embodiment, the tongue 23 has a square or rectangular cross-section with the perimeter groove 39 having a complemental square or rectangular cross-section (FIG. 5). In other embodiments, the tongue 23 can have a dovetailed form and the perimeter groove 39 can have a complemental dovetail form to allow for more secure attachment of the light module 30 to the shaft 20. Other forms of geometric contouring can be provided on the tongue 23 and perimeter groove 39, preferably of a complemental nature, to adjust the degree to which the light module 30 is held to the shaft 20 and can resist forces tending to dislodge the light module 30 from the shaft 20, or to minimize such forces (to enable simpler separation, for instance).

While the perimeter groove 39 and tongue 23 are shown on three separate sides of the light module 30 and notch 22 respectively, the tongue 23 and groove 39 could alternatively be provided on only two or one surface of the light module 30 and shaft 20 and still function effectively according to this invention. Other forms of attachment besides this complemental tongue and groove configuration could also alternatively be resorted to for removable attachment of the light module 30 to the shaft 20. For instance, fasteners could be utilized such as hook and loop type fasteners or mechanical fasteners such as snaps or buttons could be utilized. Other forms of fasteners can also conceivably be utilized to allow for removable attachment of the light module 30 to the shaft 20.

The switch 40 is preferably provided on one end of the light module 30. This end preferably places the switch 40 near a center of the comb 10. The light module 30 can potentially be reversible so that the switch 40 will end up near one end of the comb 10, rather than at a midpoint thereof, at the preference of a user. Reversibility of the light module 30 would be provided by merely swapping the tip edges 36 of the light module 30 with each other, or similarly swapping end edges 28 of the shaft 20. The switch 40 is in this preferred embodiment in the form of a button 42 which can be toggled by applying a force (such as along arrow A of FIG. 3) to cause electrical connections to be selectively made and interrupted between a source of power and a source of light. In the embodiment depicted, the button 42 is surrounded by a back housing 44 and front housing 46 which can contain elements of the button 42 or other switch 40 to achieve the selective connection and disruption of this electric circuit 60. Other forms of switches 40 could include slide switches or any other variety of switches suitable for use with low voltage circuits.

The LED 50 (or other light source) is preferably coupled to the switch 40 and to a circuit 60 in a manner which causes the LED 50 to receive electric power when the switch 40 is closed. The LED 50 is typically of a high intensity variety and is located beneath a lens 54 and within a hole 52 within the light module 30 which allows the LED 50 to shine out of the light module 30. Most preferably this hole 52 is on a side of the light module 30 opposite the switch 40, and causes light L (FIG. 3) to radiate away from the LED 50 when powered.

The circuit 60 is preferably sandwiched between the module surfaces 32 of the light module 30. This circuit 60 can be primarily comprised of a printed circuit board (PCB) 66. This PCB 66 can support batteries 62 (FIG. 4) or provide for power conditioning between batteries 62 and the LED 50. The LED 50 can be surface mounted upon a portion of the PBC 66 directly or onto a separate platform which is then mounted onto the PCB 66 or otherwise receive power from the circuit 60. The circuit 60 can also optionally include a recharge port 64 with a slot 65 therein to which an electric cable can fit to allow for electric power to recharge the batteries 62 (FIG. 4) in one embodiment of the invention. The PCB 66 or other circuit 60 can manage electric power from the batteries 62 and interface with the LED 50 and switch 40, utilizing PCB 66 or other circuit 60 design methodologies known in the art.

By providing the light module 30 separate from other portions of the comb 10, the light module 30 can be removed and other portions of the comb 10, including the shaft 20 and teeth 70, 80 can be cleaned in the same manner as combs are typically cleaned professionally. For instance, the shaft 20 and teeth 70, 80 can together be placed into a liquid 92 within a cleaner canister 90 (along arrow C of FIG. 4) for sterilization of the shaft 20 and teeth 70, 80, and without requiring that the light module 30 be manufactured in a waterproof manner. Such removable attachability of the light module 30 also facilitates the manufacture of the comb 10 in two different parts including the shaft 20 and teeth 70,

80 as a first part and the light module 30 as the second part. This two part manufacture also allows for removal of the light module 30 and replacing it with another light module 30, such as if modules having different numbers of lights or different light intensities are to be swapped onto the shaft 20. Furthermore, if the light module 30 becomes damaged or loses battery power it can be replaced without requiring replacement of the entire comb 10. Such removable attachability of the light module 30 also allows for reversibility of the light module 30 as described above.

This disclosure is provided to reveal a preferred embodiment of the invention and a best mode for practicing the invention. Having thus described the invention in this way, it should be apparent that various different modifications can be made to the preferred embodiment without departing from the scope and spirit of this invention disclosure. When structures are identified as a means to perform a function, the identification is intended to include all structures which can perform the function specified. When structures of this invention are identified as being coupled together, such language should be interpreted broadly to include the structures being coupled directly together or coupled together through intervening structures. Such coupling could be permanent or temporary and either in a rigid fashion or in a fashion which allows pivoting, sliding or other relative motion while still providing some form of attachment, unless specifically restricted.

What is claimed is:

1. A method for providing light while using a comb, the method including the steps of:

activating a light switch coupled to a light which is located upon a comb, the comb having a shaft with a plurality of teeth extending therefrom;

sterilizing the comb by providing a light module removably attachable from the shaft;

removing the light module from the shaft; and placing the shaft and teeth extending therefrom into a sanitizing liquid.

2. The method of claim 1 wherein said activating step includes finding a button on the comb which is coupled to an electric power circuit coupled to a light emitting diode providing the light on the comb; and manipulating the button to cause power to flow from the battery to the light emitting diode through the circuit and to cause light to shine from the light emitting diode.

3. The method of claim 1 including the further steps of removing the shaft with teeth extending therefrom from the sanitizing liquid;

reattaching the light module to the shaft; and repeating said activating step.

4. The method of claim 3 wherein said reattaching step includes the steps of aligning a tongue and a groove of a tongue and groove pair to fit the tongue into the groove, with one of the tongue and groove pair located upon the shaft and one of the tongue and groove pair located upon the light module.

* * * * *